United States Patent [19]

Hanschke et al.

[11] Patent Number: 4,572,996

[45] Date of Patent: Feb. 25, 1986

[54] CONTROL UNIT FOR MODEL VEHICLES

[75] Inventors: Christoph Hanschke, Göppingen-Faurndau; Roland Mayer, Reichenbach-Fils, both of Fed. Rep. of Germany

[73] Assignee: Gebrüder Märklin & Cie. Gesellschaft mit beschränkter Haftung, Göppingen, Fed. Rep. of Germany

[21] Appl. No.: 602,183

[22] Filed: Apr. 19, 1984

[30] Foreign Application Priority Data

Apr. 22, 1983 [DE] Fed. Rep. of Germany ..... 3314714

[51] Int. Cl.[4] ..... H02P 7/29

[52] U.S. Cl. ..... 318/341; 318/39; 318/16; 318/599; 318/603; 340/825.69; 180/167; 446/455

[58] Field of Search ..... 318/301, 317, 318, 341, 318/342, 343, 345 A, 345 E, 345 F, 39, 599, 16, 587, 600–608, 581; 466/455; 340/825.72, 825.56, 825.76, 825.63, 825.69; 180/167, 168; 455/162–164

[56] References Cited

U.S. PATENT DOCUMENTS

| | | | |
|---|---|---|---|
| 3,380,399 | 4/1968 | Southard et al. | 340/825.69 X |
| 3,763,954 | 10/1973 | Permut et al. | 180/167 |
| 3,811,112 | 5/1974 | Hoven et al. | 180/168 X |
| 3,874,475 | 4/1975 | Permut et al. | 180/167 |
| 4,052,646 | 10/1977 | Massey et al. | 318/341 X |
| 4,166,514 | 9/1979 | De Freminville et al. | 180/167 |
| 4,371,814 | 2/1983 | Hannas | 318/16 |
| 4,390,877 | 6/1983 | Curran | 446/455 X |
| 4,449,114 | 5/1984 | Fascenda et al. | 180/168 X |

*Primary Examiner*—William M. Shoop, Jr.
*Assistant Examiner*—Shik Luen Paul Ip
*Attorney, Agent, or Firm*—Becker & Becker, Inc.

[57] ABSTRACT

A control unit for model vehicles, such as model railway trains, model automobiles, etc. For independent operation of several model vehicles on a common electric circuit, it is known to allocate to each model vehicle a receiver coded in relation with hardware and controlled according to a binary word consisting of an address part and a data part. Control units of this type, however, have the disadvantage that they cannot be operated on analog electric circuits. With the invention, a control unit is proposed which independently switches off the digital control logic in the case of a change of the model vehicle from a digital trackage to an analog trackage, and enables operation of the model vehicle via an amplitude-controlled or pulse width-controlled analog signal.

11 Claims, 1 Drawing Figure

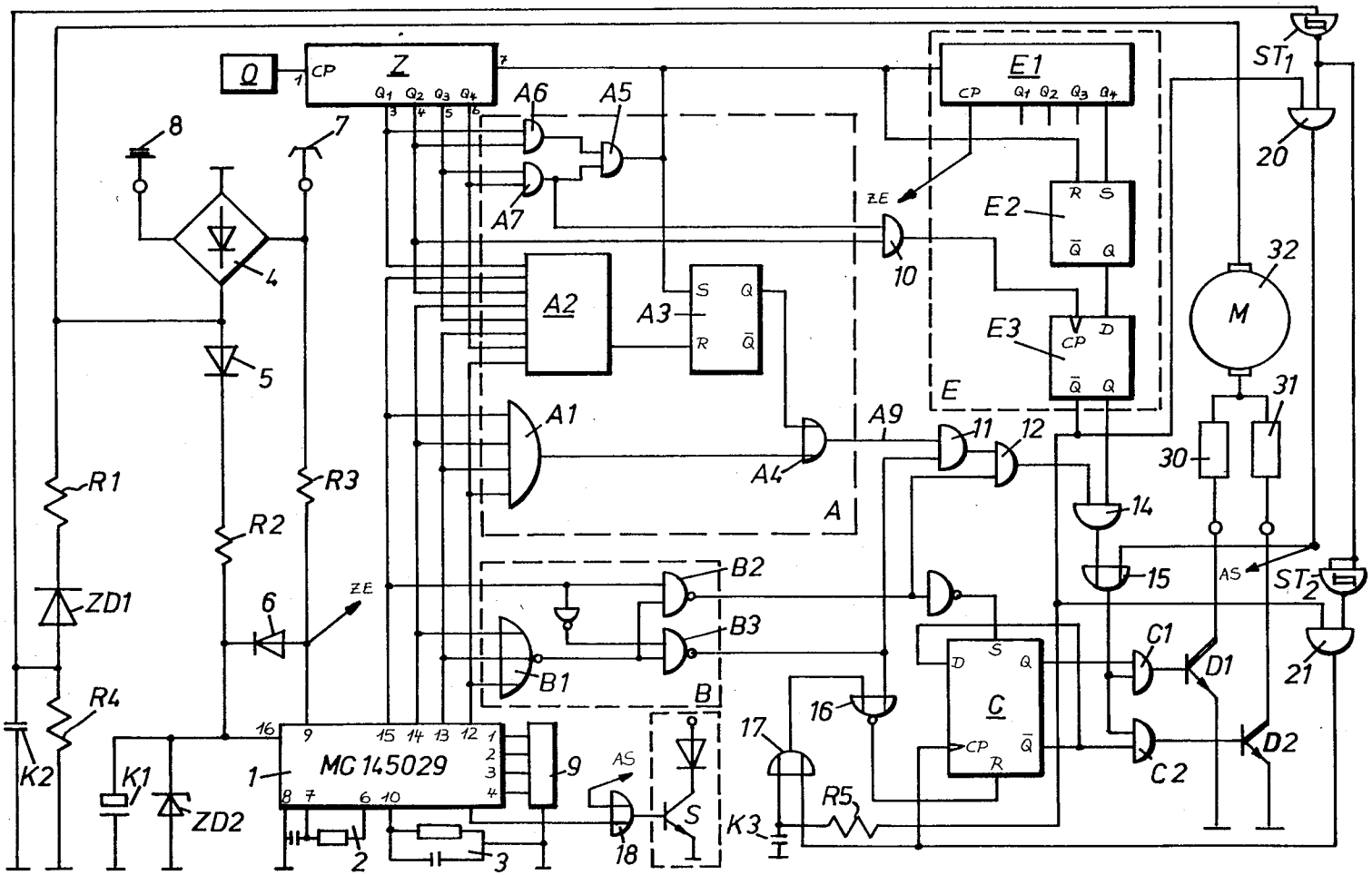
ST1
20
32
M
31
30
ST2
21
AS
D2
D1
C1
C2
14
15
E1
E2
E3
E
12
11
C
10
ZE
A9
A
16
R5
17
K3
A4
B2
B3
B
S
18
A3
A5
A2
A1
B1
9
A6
A7
Z
Q
7
R3
ZE
MC145029
3
2
1
4
5
R2
6
8
ZD2
K1
R1
ZD1
R4
K2

CONTROL UNIT FOR MODEL VEHICLES

BACKGROUND OF THE INVENTION

1. Field of the Invention

The present invention relates to a control unit for model vehicles, such as model railway trains, model automobiles, etc., which are supplied with energy, for independent operation, via a common electric circuit, and which are selected by a transmitter which, via a line bus formed by the electric circuit, transmits to a receiver arranged in the model vehicle binary words consisting of an address part and a data part. The receiver, which is coded in conformity to the address part, takes over the received data part in a register having parallel data outputs and transmits the data to an analyzer which switches, statuses, which correspond to the data, and control elements arranged in the power circuit of the motor of the model vehicle.

2. Description of the Prior Art

A control unit of this kind is known, e.g., from the German Offenlegungsschrift No. 28 46 801. By means of an encoder (transmitter), and via a line bus, information consisting of an address part and a data part is fed to a decoder (receiver). If the address part of the information transmitted is in accordance with the address in relation to hardware, and given to a decoder of the control unit, the decoder takes over the data part following the address in a register, whereby the individual bits of the data part are available via parallel data outputs for a subsequent logic. A certain control command is allocated to each specific bit-combination of the data part. For example, in the case of a 4-bit data part, 1 bit is used to reverse the driving direction of the driving motor of a model train, whereas by means of the remaining 3-bit, 8 driving steps between stop and full speed can be selected. Via operation logics, the individual bit-constellations are recognized and the corresponding driving steps are set.

In the German patent application No. P 32 32 303.4, which belongs to the assignee of the present application, there is described in detail how, on the receiver side, more than eight driving steps can be produced by means of simple measures without additional bits becoming necessary. In this application, wiring and function of a corresponding receiver (decoder) also are described in detail. Highly-complicated digital receiver modules of this kind, however, have the disadvantage that they only can be used with model vehicles which are selected by correspondingly designed transmitters. For example, a locomotive with a receiver module corresponding to the application No. P 32 32 303.4 cannot be operated on a conventional analogously operating trackage.

An object of the present invention is to design the control unit used on the receiver side in such a way that it is operable on a digitally operating trackage as well as on an analogously operating trackage, that is, that a model vehicle having digital receiving logic can be operated on an analog trackage without modification.

BRIEF DESCRIPTION OF THE DRAWING

This object, and other objects and advantages of the present invention, will appear more clearly from the following specification in conjunction with the accompanying drawing, which schematically illustrates one embodiment of the inventive control unit.

SUMMARY OF THE INVENTION

The control unit of the present invention is characterized primarily in that a counter is allocated to the control unit and has a reset-input, which is acted upon by reset pulses of constant frequency, and a counting input, which is connected with the line bus in such a way that within a time window or time interval defined by two reset pulses which follow one another, the pulses of binary words received are counted in, and that the data input of a storage is set as a function of the count of the counter in such a way that below a given count of said counter the data input assumes a first logic status, and on and after said given count of said counter assumes a second logic status; the logic status present at the data input is stored in said storage shortly before a following reset pulse. As a function of the storage fill, the control elements are time-limitedly operated, or are fully connected through, via a gate in conformity with the statuses switched by the analyzer.

In the operational state, the digital/analog detection capability of the control unit checks in successive cycles whether the model vehicle is driving on a digitally operating trackage or on an analogously operating trackage. If there is detected that via the slider digital binary words are received, that is, that the model vehicle is moving on a digital trackage, the control pulses produced in the analyzer in conformity with the data transmitted are connected through to the control elements in the power circuit of the motor. However, if the digital/analog detection capability detects that via the slider only an analog signal is received, it will block the connection of the analyzer with the control elements, and will fully connect the control elements through, so that the number of revolutions of the motor is now only changeable via the effective value of the analog signal. By means of the inventive embodiment of the control unit, there is possible to let a model vehicle change from a digitally operating trackage to an analog trackage without interruption of drive for technical reasons.

In a simple execution of the invention, a BCD or binary counter is used, the data output of which having highest decimal value is connected with the set input of an intermediate storing flip-flop, which is connected with the reset input of the counter, and the Q output state of which is connected with the data input of a D-flip-flop, which is provided as the storage, at the clock input of which a clock pulse is present which, in terms of time, is slightly in advance of the reset pulse.

Pursuant to further advantageous features of the present invention, the Q output state of the D-flip-flop may be logically interconnected with the output signals of the analyzer via an AND-gate, the output of which controls at least one control element located in the power circuit of the motor.

The $\overline{Q}$ output state of the D-flip-flop may be logically interconnected with the inverted output signal of a Schmitt-trigger via an AND-gate, the output signal of which controls at least one control element located in the power circuit; the input of the Schmitt-trigger may be connected with the positive pole of the rectified voltage of the line bus, and via a parallel connection, which comprises a capacitor and a resistor, to ground.

A flip-flop controlled as a storage or register of driving direction may be provided, the set and reset input of which are controlled via logic control directly by two allocated statuses present at the data outputs of the receiver, preferably digitally 0000 and 0001; the storage of driving direction may be controllable independently of the set and reset input in toggle operation, with the data input being connected with an output of the storage of driving direction, and the clock input being connected with the output of an AND-gate, the inputs of which are connected, on the one hand, with the $\overline{Q}$output state of the D-flip-flop of the digital/analog identification, and, on the other hand, via two inverting Schmitt-triggers with the rectified voltage of the line bus; the outputs of said storage of driving direction each select a gate, at the other input of which are present the pulses which control the control elements.

A ring counter which counts up with impressed frequency may be provided; setting a flip-flop before counting starts, with the latter being reset by the output signal of a 4-bit comparator when the logic statuses of the data outputs of the receiver coincide with the logic statuses of the corresponding counting outputs of the ring counter; the Q output state of the flip-flops emits the control pulses for the control elements. The data outputs of the receiver may be connected with the inputs of a 4-bit AND-gate, the output signal of which is fed as a control pulse to the control elements.

DESCRIPTION OF PREFERRED EMBODIMENTS

Referring now to the drawing in detail, the input circuit with the receiver module 1 (decoder) corresponds to the input circuit described in the aforementioned German patent application No. P 32 32 303.4. This input circuit consists mainly of a bridge rectifier 4 which receives, via the sliders 7, 8 of a non-illustrated, especially rail-bound model vehicle, supply voltage as well as the information signal; the supply voltage of the information which is to be transmitted can be appropriately coded, and then is at the same time the information signal.

The positive direct current output of the bridge rectifier 4 is connected with the voltage input 16 of the decoder 1 via a diode 5, which is connected in the forward direction, as well as via a resistor R2; for voltage stabilization, a Zener or breakdown diode ZD2 having a parallelly connected electrolytic capacitor K1 is connected from the voltage input 16 of the decoder to ground. The slider 7 is connected directly with the data input 9 of the decoder 1 via a resistor R3; the data signals received are drawn to the potential of the voltage supply via the diode 6, which is connected from the data input 9 to the voltage input 16.

The RC-networks 2 and 3 of the decoder 1 conform to the requirements determined by the components, and are designed in accordance with the frequency of the information signal which is to be received, in order to produce a time window which corresponds to the address and data part of the binary words received. With regard to the adaptation of the non-illustrated encoder module to the decoder 1, reference is made to the aforementioned German Patent application No. P 32 32 303.4.

Coding of the decoder 1, i.e. the allocation of a given address, is effected via the coding block 9, which can be formed by individual switches which selectively place the coding inputs 1 to 4 of the decoder 1 to logically "0", "1", or "Z" (Z≙open input), in order to thus impress an address to the decoder in relation to hardware.

If the decoder 1 receives a binary word having an address corresponding with its coding in relation with hardware, the data part following the address part is taken over in a register of the decoder 1 and is stored until a new data part, allocated to the decoder 1, is received.

The stored data are in the binary code at the data outputs 12 to 15 of the decoder 1, and fix the driving step, the driving direction and, if applicable, special functions. In accordance with the driving step chosen, as well as with the driving direction, the Darlington-transistors D1 or D2 arranged in the power circuit are activated by means of pulse sequences; the width of the individual pulses of the driving step chosen is produced correspondingly by means of the analyzer A. For this purpose, the data outputs 12 to 15 of the decoder 1 are connected with a 4-bit comparator A2 which compares the logical statuses of the data outputs 12 to 15 with the corresponding binary outputs 3 to 6 of a ring counter Z that permanently counts up from logically 0000 (decimal: 0) to logically 1111 (decimal: 15) in accordance with an impressed frequency of an oscillator O. Via logic operation of three AND-gates A5, A6, A7, when the decimal value is 15 at the output of gate A5, a reset pulse is produced which is fed to the reset input of the ring counter Z, so that the latter resets to logically 0000 (decimal: 0) with each reset pulse. In the illustrated embodiment, the frequency of the oscillator is chosen in such a way that about every 12 milliseconds a reset pulse is generated at the output of the logic AND-operation.

The reset signal produced by the AND-logical interconnection A5, A6, A7 is fed to the set input of a flip-flop A3, the reset input of which is connected with the output of the 4-bit-comparator A2. With each reset pulse at the set input of the flip-flop A3, the latter is set, that is, its Q output state assumes the logical status "1". At an equal state of the counting step at the binary outputs of the ring counter Z with the driving step at the binary data outputs 12 to 15 of the decoder 1 and read in via the data input 9, the 4-bit comparator A2 generates an output-signal which—via the reset input R of the flip-flop A3—resets the latter. At the Q output state, therefore, a pulse is generated, the width of which is dependent on the driving step; i.e. the binary-number, stored in the decoder 1. If a smaller driving step (smaller binary number) is preselected, the reset signal of the 4-bit comparator A2 follows the reset pulse which sets the flip-flop A3 relatively quickly, so that the pulse at the output Q of the flip-flop is only relatively narrow. With higher driving steps (e.g., driving step decimal 13, i.e. digital 1101), the signal of the 4-bit comparator which resets the flip-flop A3 follows relatively late, as a result of which the pulse width of the signal generated at output Q is relatively great.

Since with the driving step decimal 15 (digital 1111), the signal of the AND-connection A5, A6, A7 which sets the flip-flop A3, and the output signal of the 4-bit comparator A2 which resets the flip-flop A3, are generated almost simultaneously, and therefore the Q output state of the flip-flop A3—counter to the driving step chosen—generates only a very narrow pulse, a 4-bit AND-gate A1 which logically connects the binary data outputs 12 to 15 of decoder 1 is provided, the output of which is connected via an OR-gate A4 with the Q output state of the flip-flop A3, so that at the output A9 of the analyzer A there is always a pulse having a pulse width corresponding with the driving step chosen; this pulse controls—via gates described in detail in the following—the Darlington power transistors D1 and D2.

Via the logic control B, the driving direction, or a change of driving direction, is read in. The change of driving direction is read in accordance with the present logical status of the data output 15 of the decoder 1 having the lowest decimal value, and this is so always only in a situation wherein all outputs having higher decimal values show a logical "0". The three outputs 12, 13, 14 which have higher decimal values are fed to a 3-input NOR-gate B1, the output of which is connected with an input of both 2-input NAND-gates B2 and B3. The other input of the NAND-gate B2 is directly connected with the data output 15 having the lowest decimal value, while the other input of the NAND-gate B3 is connected with the inverted data output 15.

The output of the NAND-gate B2 is invertedly fed to the set-input of a flip-flop which is connected as a driving direction register or storage C. The reset input R of the driving direction register C is connected with the output of a NOR-gate 16, one input of which is connected with the output of the NAND-gate B3.

The pulses generated at the output A9 of the analyzer A for the control of the Darlington-transistors D1 and D2 are each fed to an input of a 2-input AND-gate C1 and C2. The second input of the AND-gate C1 is connected with the Q output state of the driving direction register C, and the second input of the AND-gate C2 is connected to the $\overline{Q}$ output of the driving direction register C.

If now the digital number 0001 is present at the data output of the decoder 1, the driving direction register C is set via the logic control B, and the logical "1" then present at the Q output releases the AND-gate C1, so that pulses coming from the analyzer A activate the Darlington-transistor D1, which allows a current, limited in terms of time in conformity with the pulse width, through the exciter coil 30 and the motor 32, so that the motor runs at the number of revolutions which corresponds to the driving step chosen, and in the revolution direction allocated to the exciter coil.

If at the data outputs of the decoder logically 0000 is present, the driving direction register C is reset by the logic control B, and the AND-gate C2 is opened via the $\overline{Q}$output state; at the same time, the AND-gate C1 is blocked. Now, in conformity with the pulse width of the pulses at the output line A9, only the Darlington-transistor D2 is selected, and current is allowed through the exciter coil 31 and the motor 32; the motor now revolves in the opposite direction at a number of revolutions corresponding to the driving step chosen.

The motor 32, together with the selected exciter coil 30 or 31, are at the full direct current of the bridge rectifier 4 when a Darlington-transistor D1 or D2 is switched through.

Two AND-gates 11 and 12, which are connected in series with the output A9, are further selected by the outputs of the NAND-gates B2 and B3. These AND-gates are intended to ensure that only with fixed driving direction, that is, if the operation connection B has taken a stable status in conformity with the driving direction, will the pulses corresponding to the driving step be connected through. For this purpose, output A9 is connected with the output of the NAND-gate B3 via the AND-gate 11, the output of which is connected with the output of the NAND-gate B2 via the AND-gate 12. In the presence of not defined logical statuses, at least one AND-gate 11 or 12 is blocking and, thus, stops the model vehicle, since—with digital operation—the Darlington-transistors D1 and D2 cannot be selected.

In order to be able to operate the model vehicle with analog as well as with digital driving voltage without trouble, an analog/digital identification E is provided which mainly consists of a counter E1 and two flip-flops E2 and E3. The counting input ZE of the binary counter E1 is supplied, in conformity to the data input 9 of the decoder 1, with the pulses of the binary words transmitted via the line bus. The reset input of the counter E1 is connected with the output of the operation logic A5, A6 and A7; in other words, the BCD-counter E1 is reset simultaneously with the ring counter Z, and in particular then when the ring counter has reached the digital value 1111. At the output Q4 (decimal 8) which has the highest decimal value, the set input of the flip-flop E2 is connected, the reset input R of which is connected with the reset input of the counter E1. The Q output state of the flip-flop E2 is connected with the data input D of the D-flip-flop E3, which in the illustrated embodiment is connected as a register or storage. The clock or pulse input CP of the D-flip-flop E3 is connected with the output of an AND-gate 10, the inputs of which are wired in such a way that the AND-gate 10 always gives a signal when the ring counter Z has reached decimal 14. The Q output state of the D-flip-flop E3 is connected with the output of the series connection of the AND-gates 11 and 12 via an AND-gate 14, so that the pulses on the output line A9 only can be connected through if, on the one hand, the operation logic B has assumed a defined status and, on the other hand, the D-flip-flop E3 is set, which indicates the digital operation. The output of the AND-gate 14 is fed via an OR-gate 15 to an input of the gates C1 and C2 selected by the driving direction register C in order to be connected through to the one or other Darlington-transistor D1 or D2 in accordance with the driving step chosen as was already described in detail above.

The digital/analog identification E operates as follows:

The binary counter E1 counts, within a cycle of about 12 milliseconds which is produced by the reset pulses of the operation A5 to A7 in connection with the ring counter Z, the pulses of the binary words arriving on the line bus, that is, the pulses of the voltage scanned by the slider 7. If within two successive reset pulses, which determine the cycle (gate time), more than 8 pulses are received at the counting input, which is principally exceeded with digital operation, at the Q4 data output of the binary counter E1 a logical "1" is present, whereupon the flip-flop E2 is set. The Q output state of the flip-flop E2 is connected with the data input D of the D-flip-flop E3, so that when the flip-flop E2 is set, a logical "1" is present at the data input D. If the ring counter Z reaches the count of decimal 14, the AND-gate 10 emits a pulse and the logical "1" present at the data input D of the D-flip-flop E3 is read in, that is, the D-flip-flop E3 is set. If the ring counter Z now reaches decimal 15, the flip-flop E2 and the binary counter E1 are again reset, and the counting cycle starts anew. If the counter E1 counts less than 8 pulses, the Q4-output is not set, resulting in the fact that with a following pulse of the AND-gate 10, the logical "0" at the output Q of the flip-flop E2 is taken over in the D-flip-flop E3. The clock pulse present at the clock input CP of the D-flip-flop E3—as a result of the description above—is always present shortly before the reset pulse which resets the flip-flop E2 and the counter E1.

The outputs of the D-flip-flop E3 indicate directly whether an analog or a digital input signal is present at the slider 7. If at the Q output state of the D-flip-flop E3 a logical "1" is present ($\overline{Q}$ output is then logically "0"), the AND-gate 14 is released and the Darlington-transistors D1 or D2 are selected as a function of the pulses produced in the analyzer A, and of the driving direction register C. If a logical "0" is present at the output Q, the AND-gate 14 is blocked. The logical "1" then present at the output $\overline{Q}$ is fed to an AND-gate 20, the other input of which is connected with the inverting output of a Schmitt-trigger ST1, the input of which, in turn, is connected to the positive pole of the bridge rectifier 4 via a Zener diode ZD1 and a resistor R1, and is connected via a parallel connection, which comprises a resistor R4 and a capacitor K2, to ground. In the case of an analog voltage at the slider 7, therefore, a logical "1" will be present at the output of the AND-gate 20, as a result of which, via the OR-gate 15 and the gate C1 or C2 released by the driving direction register C, the respective Darlington-transistor D1 or D2 is fully advanced, so that the number of revolutions of the motor 32 can now only be controlled via the effective value of the driving voltage.

The output of the AND-gate 20 is further connected with an input of an OR-gate 18; this is indicated in the drawing by means of arrows AS (analog signal), which are directed towards each other. Due to the output signal of the AND-gate 20, special function connections S are disconnected in the analog operation, since in analog operation only driving speed and driving direction can be chosen.

The output of the inverting Schmitt-trigger ST1, via another inverting Schmitt-trigger ST2, is logically connected with the $\overline{Q}$ output of the D-flip-flop E3 via an AND-gate 21, the output of which is connected, on the one hand, with the clock input of the driving direction register C and, on the other hand, with the input of an OR-gate 17. The other input of the OR-gate 17 is connected via a resistor R5 with the $\overline{Q}$ output state of the flip-flop E3 and is connected to ground via a capactor K3. The output of this OR-gate 17 is connected with the free input of the NOR-gate 16. By means of the RC-network of the one input of the OR-gate 17 it is guaranteed that the driving direction storage C is reset with starting the circuit via the reset input by means of which a preferential driving direction is determined and the circuit takes a defined output status when starting.

The change-over of driving direction is effected in analog operation by means of an overvoltage signal, which is given to the connection via slider 7. If an overvoltage signal is present, the Schmitt-trigger ST1 is set to logically "0" for a short time based on the capacitor K2; as a result, the AND-gate 20 blocks for a short time, a logical "0" being present at its output; therefore, both AND-gates C1 and C2 are blocked for the duration of the overvoltage signal, so that the overvoltage signal has no influence on the motor 32. At the output of the Schmitt-trigger ST2, a logical "1" is present at the time of the overvoltage signal, as a result of which the AND-gate 21 is connected through, since at its other input a logical "1" of the digital/analog identification E is present. The output signal of the AND-gate 21 is transmitted to the clock input CP of the driving direction register C, as a result of which the latter—now operating in toggle operation—is switched over. When a clock signal is present, the signal present at the data input D of the driving direction register C is read in, whereby the data input D is directly connected with its output $\overline{Q}$ Via the gates 16 and 17, at "1" of the AND-gate 21, there is at the same time ensured that the reset input of the driving direction register C is on logically "0".

The present invention is, of course, in no way restricted to the specific disclosure of the specification and drawing, but also encompasses any modifications within the scope of the appended claims.

What we claim is:

1. A control unit for model vehicles which are supplied with energy, for independent operation, via a common electric circuit, and which are selected by a transmitter which, via a line bus formed by the electric circuit, transmits to a receiver arranged in the model vehicle binary words consisting of an address part and a data part; the receiver, which is coded in conformity with the address part, takes over the received data part in a register having parallel data outputs and transmits it to an analyzer which switches statuses, which correspond to the data, and control elements, which are arranged in the power circuit of the motor of the model vehicle; the improvement comprises:

a counter having a reset imput, which is acted upon by reset pulses of constant frequency, and having a counting input, which is connected with said line bus in such a way that within a time window defined by two reset pulses which follow one another, the pulses of binary words received are counted in;

a storage having a data input which is set as a function of the count of said counter in such a way that below a given count of said counter said data input assumes a first logic status, and on and after said given count assumes a second logic status; the logic status present at said data input is stored in said storage shortly before a following reset pulse; and a first gate for time-limitedly operating, or for fully connecting through, in conformity with the statuses switched by said analyzer, said control elements as a function of the storage fill of said storage; said storage being a D-flip-flop having a clock input at which is present a clock pulse which in terms of time is slightly in advance of said reset pulse; said D-flip-flop having a Q output state; and which includes as said first gate a first AND-gate for logically interconnecting said Q output state of said D-flip-flop with output signals of said analyzer; said first AND-gate having an output which controls at least one of said control elements.

2. A control unit according to claim 1, which includes an intermediate storing flip-flop, which has a set input, and a Q output state which is connected with said data input of said storage; and in which said counter is a binary counter, with the data output thereof having the highest decimal value being connected with said set input of said intermediate storing flip-flop.

3. A control unit according to claim 2, in which said intermediate storing flip-flip has a reset input, which is connected with said reset input of said counter.

4. A control unit according to claim 1, in which said storage is a D-flip-flop having a clock input at which is present a clock pulse which in terms of time is slightly in advance of said reset pulse.

5. A control unit according to claim 4, in which said D-flip-flop has a Q output state; and which includes as said first gate a first AND-gate for logically interconnecting said Q output state of said D-flip-flop with output signals of said analyzer; said first AND-gate has an output which controls at least one of said control elements.

6. A control unit for model vehicles which are supplied with energy, for independent operation, via a common electric circuit, and which are selected by a transmitter which, via a line bus formed by the electric ciruit, transmits to a receiver arranged in the model vehicle binary words consisting of an address part and a data part; the receiver, which is coded in conformity with the address part, takes over the received data part in a register having parallel data outputs and transmits it to an analyzer which switches statuses, which correspond to the data, and control elements, which are arranged in the power circuit of the motor of the model vehicle; the improvement comprises:

a counter having a reset input, which is acted upon by reset pulses of constant frequency, and having a counting input, which is connected with said line bus in such a way that within a time window defined by two reset pulses which follow one another, the pulses of binary words received are counted in;

a storage having a data input which is set as a function of the count of said counter in such a way that below a given count of said counter said data input assumes a first logic status, and on and after said given count assumes a second logic status; the logic status present at said data input is stored in said storage shortly before a following reset pulse;

a first gate for time-limitedly operating, or for fully connecting through, in conformity with the statuses switched by said analyzer, said control elements as a function of the storage fill of said storage; said storage being a D-flip-flop having a clock input at which is present a clock pulse which in terms of time is slightly in advance of said reset pulse; and a first Schmitt-trigger, which has an inverted output signal and an input; in which said D-flip-flop has a $\overline{Q}$ output state; which includes a second AND-gate for logically interconnecting said $\overline{Q}$ output state of said D-flip-flop with said inverted output signal of said first Schmitt-trigger; said second AND-gate having an output signal which controls at least one of said control elements; which includes a parallel connection comprising a capacitor and a resistor; and in which said input of said firt Schmitt-trigger is connected with the positive pole of the rectified voltage of said line bus, and, via said parallel connection, to ground.

7. A control unit for model vehicles which are supplied with energy, for independent operation, via a common electric circuit, and which are selected by transmitter which, via a line bus formed by the electric circuit, transmits to a receiver arranged in the model vehicle binary words consisting of an address part and a data part; the receiver, which is coded in conformity with the address part, takes over the received data part in a register having parallel data outputs and transmits it to an analyzer which switches statuses, which correspond to the data, and control elements, which are arranged in the power circuit of the motor of the model vehicle; the improvement comprises:

a counter having a reset input, which is acted upon by reset pulses of constant frequency, and having a counting input, which is connected with said line bus in such a way that within a time window defined by two reset pulses which follow one another, the pulses of binary words received are counted in;

a storage having a data input which is set as a function of the count of said counter in such a way that below a given count of said counter said data input assumes a first logic status, and on and after said given count assumes a second logic status; the logic status present at said data input is stored in said storage shortly before a following reset pulse;

a first gate for time-limitedly operating, or for fully connecting through, in conformity with the statuses switched by said analyzer, said control elements as a function of the storage fill of said storage; said storage being a D-flip-flop having a clock input at which is present a clock pulse which in terms of time is slightly in advance of said reset pulse; and a flip-flop which is controlled as a driving direction storage and has a set input, a reset input, data input, Q and $\overline{Q}$ outputs, and a clock input; which includes a logic control for directly controlling said set and reset inputs of said driving direction storage by two allocated statuses present at the data outputs of said receiver; said driving direction storage is controllable independently of said set and reset inputs thereof in toggle operation, with said data input thereof being connected with one of said outputs thereof; which includes a third AND-gate having an output and inputs, with said clock input of said driving direction storage being connected with said output of said third AND-gate; in which said D-flip-flop is part of a digital/analog identification, and has a $\overline{Q}$ output state; which includes two inverting Schmitt-triggers; said inputs of said third AND-gate being connected on the one hand with said $\overline{Q}$ output state of said D-flip-flop, and on the other hand, via said two inverting Schmitt-triggers, with the rectified voltage of said line bus; and which includes fourth and fifth gates, each of which has first and second inputs, with said Q and $\overline{Q}$ outputs of said driving direction storage each selecting one of said fourth and fifth gates at said first inputs thereof, with the pulses which control said control elements being present at said second inputs thereof.

8. A control unit according to claim 7, in which said two allocated statuses present at the data outputs of said receiver are digitally 0000 and 0001.

9. A control unit for model vehicles which are supplied with energy, for independent operation, via a common electric circuit, and which are selected by a transmitter which, via a line bus formed by the electric circuit, transmits to a receiver arranged in the model vehicle binary words consisting of an address part and a data part; the receiver, which is coded in conformity with the address part, takes over the received data part in a register having parallel data outputs and transmits it to an analyzer which switches statuses, which correspond to the data, and control elements, which are arranged in the power circuit of the motor of the model vehicle; the improvement comprises:

a counter having a reset input, which is acted upon by reset pulses of constant frequency, and having a counting input, which is connected with said line bus in such a way that within a time window defined by two reset pulses which follow one another, the pulses of binary words received are counted in;

a storage having a data input which is set as a function of the count of said counter in such a way that below a given count of said counter said data input assumes a first logic status, and on and after said given count assumes a second logic status; the logic status present at said data input is stored in said storage shortly before a following reset pulse;

a first gate for time-limitedly operating, or for fully connecting through, in conformity with the statuses switched by said analyzer, said control elements as a function of the storage fill of said storage; and a ring counter which counts up with impressed frequency; which includes a flip-flop which is set by said ring counter before counting starts; which includes a 4-bit comparator having an output signal which resets said flip-flop when the logic statuses of the data outputs of said receiver coincide with the logic statuses of the corresponding counting outputs of said ring counter; and in which said flip-flop has a Q output state which emits the control pulses for said control elements.

10. A control unit according to claim 9, which includes a 4-bit AND-gate having inputs to which are connected the data outputs of said receiver; said 4-bit AND-gate has an output signal which is fed as a control pulse to said control elements.

11. A control unit for model vehicles such as model railway trains, model automobiles and the like with features including the electrical motors of model vehicles supplied with energy via a common electric circuit, control switch elements comprising Darlington-transistors arranged in the electric circuit of the motor, said electric circuit being connected with a transmitter which transmits binary words via the electric circuit serving as a supply-conductor bus, with the binary words consisting of an address portion with a data portion, the binary words being transmitted by the transmitter via the electric circuit and being received in every model vehicle by a receiver module (decoder) connected with the electric circuit, each receiver module (decoder) being coded for a particular address of its own, such that if the coded address of a receiver module (decoder) of one model vehicle agrees or coincides with the address portion of a transmitted binary word, accordingly the data portion received upon the address portion is taken over in a register in the receiver module (decoder), said register being connected with an evaluation circuit analyzer which produces control signals corresponding to the data portion and actuates the switch elements comprising Darlington-transistors via grating gate (output) and accordingly being operative to regulate and control the speed of the motor, the improvements in combination therewith additionally comprising:

a digital/analog identification unit including a counter of which the reset input has reset impulses of fixed frequency applied thereto and of which the counter input is connected with the electric circuit/supply-conductor bus;

said counter serving to count all impulses of received binary words within a time interval (window) determined by two sequential reset impulses following one upon another;

above a predetermined counter position of the counter, the data input of a storage flip-flop being set at a first logic condition (logic 1);

below this prescribed counter position of the counter, the data input of the storage flip-flop being set at a second logic condition (logic 0), the condition (0 or 1) applicable at the data input being stored away in the storage flip-flop shortly before a subsequently following reset impulse;

the storage content being associated and tied together with the control signals of an analyzer evaluation circuit via the grating gate, whereby the output of the grating gate actuates a switch element or Darlington-transistor located in the power circuit;

with the first logic condition (logic 1) of the storage or flip-flop, the grating gate being opened for the control signals of the analyzer evaluation circuit and the switch elements being actuated by the control signals of the analyzer evaluation circuit (digital operation); and in the second logic condition (logic 0) of the storage flip-flop, the grating gate being blocked and closed for the control signals of the analyzer evaluation circuit and the switch elements comprising Darlington transistors which are connected-through in such a manner that the unchanged voltage amplitude of the current circuit is applied at the motor.

* * * * *